US008001651B2

(12) United States Patent
Chang

(10) Patent No.: US 8,001,651 B2
(45) Date of Patent: Aug. 23, 2011

(54) FLOOR WASHING ROBOT

(75) Inventor: Wen-Chung Chang, Taipei (TW)

(73) Assignee: National Taipei University of Technology (TW)

( * ) Notice: Subject to any disclaimer, the term of this patent is extended or adjusted under 35 U.S.C. 154(b) by 506 days.

(21) Appl. No.: 12/142,088

(22) Filed: Jun. 19, 2008

(65) Prior Publication Data

US 2009/0314318 A1 Dec. 24, 2009

(51) Int. Cl.
*A47L 9/28* (2006.01)

(52) U.S. Cl. ..... 15/319; 15/327.4; 15/339

(58) Field of Classification Search ..... 15/319, 15/327.4, 339; *A47L 9/28*
See application file for complete search history.

(56) References Cited

U.S. PATENT DOCUMENTS 3,789,947 A * 2/1974 Blumrich ..... 180/6.48
6,163,923 A * 12/2000 Hefter ..... 15/340.4
6,745,431 B2 * 6/2004 Dijksman et al. ..... 15/319
7,293,790 B2 * 11/2007 Byun et al. ..... 280/262
7,320,149 B1 * 1/2008 Huffman et al. ..... 15/320

* cited by examiner

*Primary Examiner* — David A Redding
(74) *Attorney, Agent, or Firm* — Schmeiser, Olsen & Watts, LLP

(57) ABSTRACT

A floor washing robot is disclosed. The robot includes: a control unit for controlling a power source to drive at least three omnidirectional wheels and at least one washing disc to rotate to wash a floor; a water spray device for spraying water; and a vacuum device for vacuuming waste water or dirt. The floor washing robot can be moved freely in any direction to improve the cleaning effect.

12 Claims, 5 Drawing Sheets

FLOOR WASHING ROBOT

FIELD OF THE INVENTION

The present invention relates to a floor washing robot, and more particularly to a floor washing robot having no particular limitation to the angle of its moving posture to improve the cleaning effect.

BACKGROUND OF THE INVENTION

In our busy life, most people, regardless of persons having a family or singles have to work during the day and take care of the housework after work. It is very tiresome to clean the floor of their home after a day of busy work, and thus we hope that we could have a robot to do the housework for us.

To meet the foregoing requirement, manufacturers applied their research result of robots to our daily life and manufactured household service robots with an intelligent and humanistic design to meet the requirement of the general public. In other words, manufacturers have already produced robots that can do the tiresome housework for us and bring tremendous convenience to our daily life.

Further, since the air of modern cities includes sands or dusts and exhaust gas discharged from motor vehicles, and thus the air pollution affects the living environment of the people, and it is necessary to keep the house clean and wash the floor frequently to maintain a high-quality living environment.

Traditionally, we usually carry a bucket of water to wash or mop a floor, and we all know that such cleaning work is very tiresome. Since most of us have to work in daytime, and it is very laborious to carry out such a heavy housework after the office work. Particularly to the elderly or patients with an injured waist or knee, the floor washing job is definitely a heavy burden.

From the description above, a floor washing robot has been developed, but the existing floor washing robots such as the Scooba floor washing robots generally have a mechanical design with a limitation of its posture direction, and the robot can move forward with a specific angular range only, and has to make devious routes or turns during the washing job.

Furthermore, the traditional floor washing robots usually come with a cleaning mechanism having a small brush area, and the robot cannot maximize the utility of the cross section of the mechanical design of the floor washing robot, and thus lowering the clean level of the washing job. For example, when the floor washing robot encounters an obstacle, the robot cannot reach or clean the area between the front edge of the floor and the brush due to the aforementioned issues of the moving angle and the brush area, and the mechanical design of the robot.

SUMMARY OF THE INVENTION

In view of the foregoing shortcomings of the prior art, the inventor of the present invention based on years of experience in the related field to conduct extensive researches and experiments, and finally developed a floor washing robot in accordance with the present invention to overcome the shortcomings of the prior art.

Therefore, it is a primary objective of the present invention to provide a floor washing robot that needs not to make turns at a spot in a certain path before moving forward due to the limitation of its mechanical design while the robot is washing a floor of a house. In other words, the floor washing robot of the invention can move forward in any direction freely under the posture direction without any particular limitation. Meanwhile, the improved washing structure can greatly increase the washing range to achieve the effects of increasing the washing area and enhancing the cleaning level of the washing job.

To achieve the foregoing objective, the present invention provides a floor washing robot comprising a machine body, at least three omnidirectional wheels, at least one washing disc, a water spray device, a vacuum device, a power source and a control unit.

The machine body includes a circumferential surface, and each omnidirectional wheel includes an outer roller and a plurality of inner rollers, wherein the outer roller is equiangularly and pivotally coupled to a circumferential surface of the machine body and rotated with respect to the machine body, and the plurality of inner rollers are pivotally and respectively coupled to the outer rollers and rotated with respected to outer rollers, and the rotating direction of the outer roller is not parallel to the rotation of the plurality of inner rollers.

Further, the at least one washing disc is pivotally coupled to the machine body and rotated with respect to the machine body. The at least one washing disc includes: a plurality of brush structures installed downward. The water spray device installed to the machine body and having at least one water spray pipeline, wherein the at least one water spray pipeline is extended to the at least one washing disc. The vacuum device is installed to the machine body and having at least one vacuum pipeline, wherein the vacuum pipeline has a slit.

Further, the power source is installed to the machine body and coupled to each omnidirectional wheel and the at least one washing disc respectively, and the control unit is installed to the machine body and electrically and respectively coupled to the water spray device, the vacuum device and the power source.

In use, the control unit can control the power source to drive each omnidirectional wheel and the washing disc to rotate with respect to the machine body, such that the floor washing robot can move forward or carry out the washing job. In the meantime, the control unit controls the water spray device to spray water or cleanser to the washing disc from the water spray pipeline, and also controls the vacuum device for the vacuum operation through the slit of the vacuum pipeline.

With the foregoing structure, the floor washing robot of the invention needs not to make turns at a spot in a certain path before moving forward due to the limitation of its mechanical design while the robot is washing a floor of a house. In other words, the floor washing robot of the invention can move forward in any direction under the posture direction freely without any particular limitation. Meanwhile, the improved washing structure can greatly increase the washing range to achieve the effects of increasing the washing area and enhancing the cleaning level of the washing job.

DESCRIPTION OF THE PREFERRED EMBODIMENT

The above and other objects, features and advantages of the present invention will become apparent from the following detailed description taken with the accompanying drawings.

Figure 1:
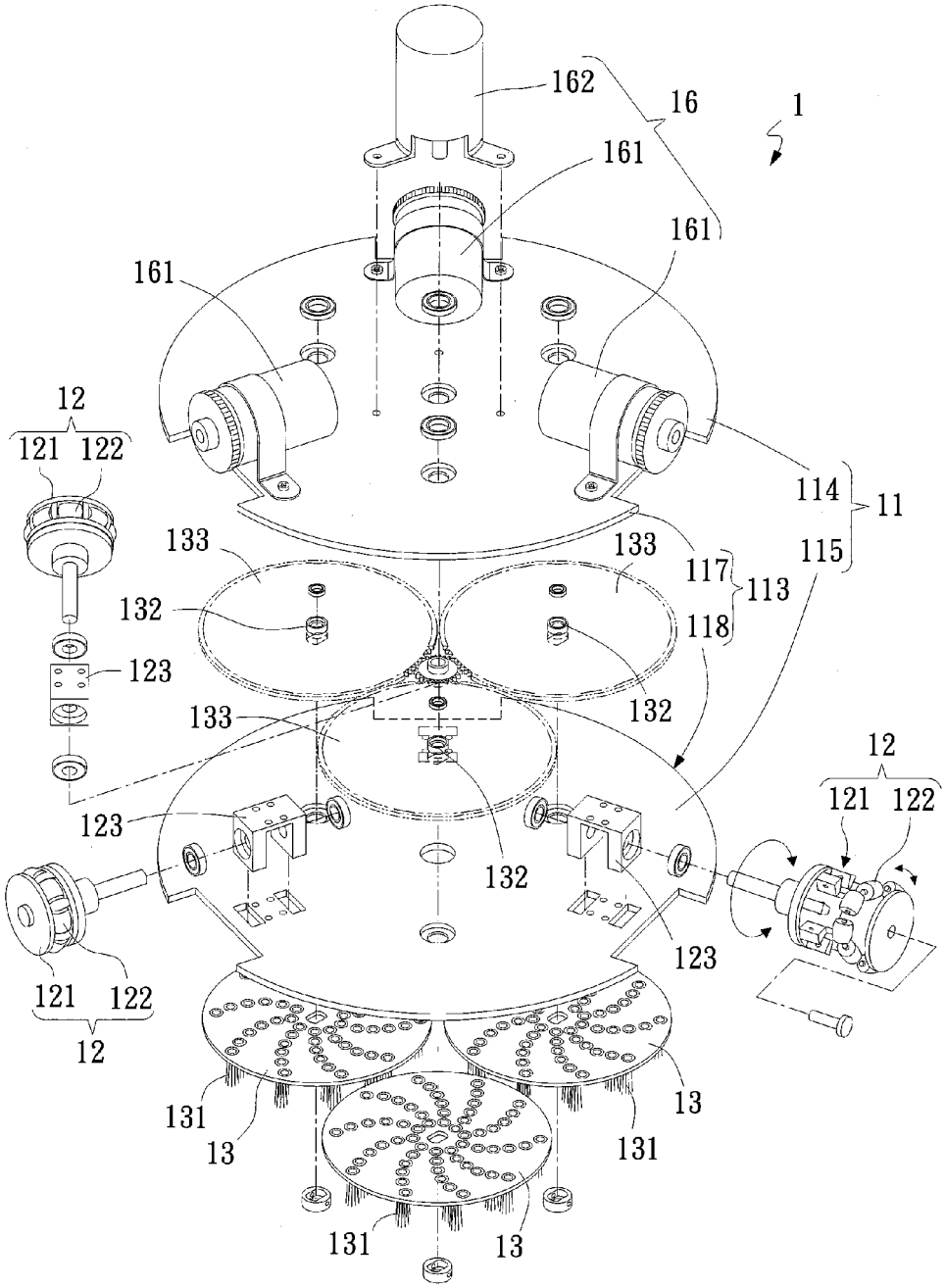
FIG. 1 is an exploded view of a first preferred embodiment of the present invention.
Figure 2:
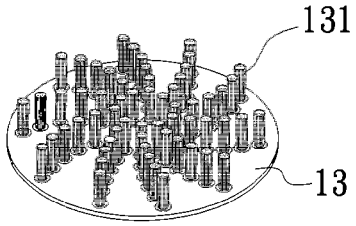
FIG. 2 is a perspective view of a washing disc in accordance with a first preferred embodiment of the present invention.
Figure 3:
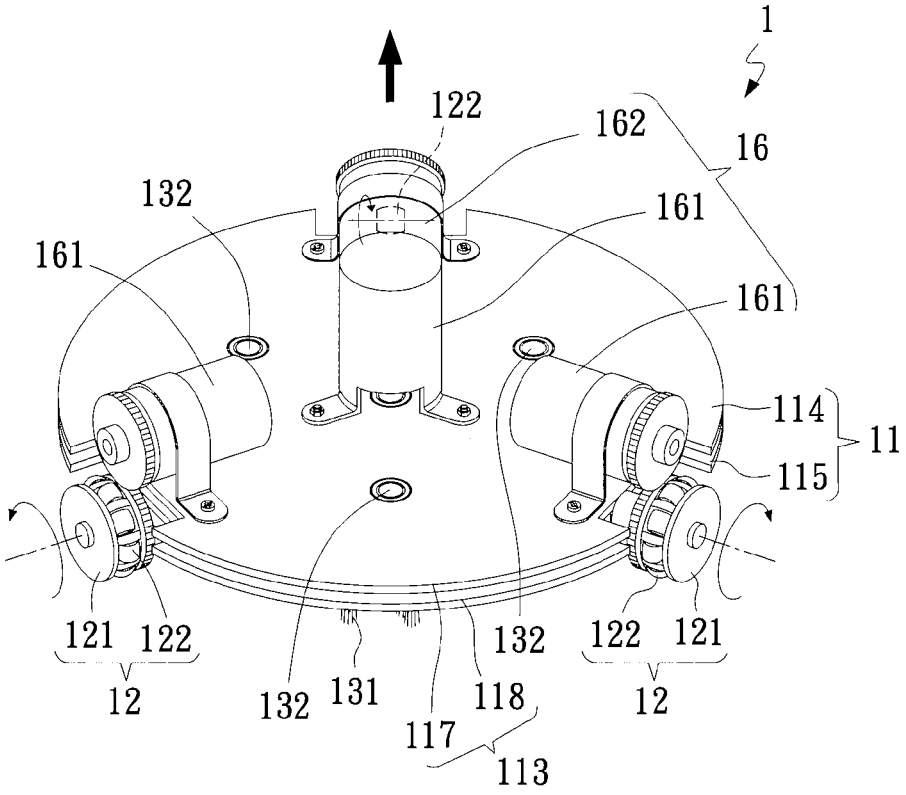
FIG. 3 is a perspective view of a first preferred embodiment of the present invention.

Referring to FIGS. 1 to 3 for an exploded view of a first preferred embodiment of the invention, a perspective view of a washing disc in accordance with a first preferred embodiment of the invention, and a perspective view of a first preferred embodiment of the invention, the figures show a lower half of the structure of a floor washing robot 1 in accordance with the present invention, and the floor washing robot 1 comprises a machine body 11, three omnidirectional wheels 12, three washing discs 13 and a power source 16.

In this preferred embodiment, the machine body 11 includes a lid 116, an upper baseboard 114 and a lower baseboard 115 (refer to FIG. 4 for the lid 116 and FIGS. 1 and 3 respectively for the upper baseboard 114 and the lower baseboard 115), and the machine body 11 also includes a circumferential surface 113, and the circumferential surface 113 has an upper circumferential surface 117 and a lower circumferential surface 118, wherein the upper circumferential surface 117 is disposed at the upper baseboard 114, and the lower circumferential surface 118 is disposed at the lower baseboard 115.

In the figures, each omnidirectional wheel 12 includes an outer roller 121 and a plurality of inner rollers 122, wherein the outer roller 121 is equiangularly and pivotally coupled to the circumferential surface 113 of the machine body 11 and rotated with respect to the machine body 11, and the plurality of inner rollers 122 are respectively and pivotally coupled to the outer roller 121 and rotated with respect to the outer roller 121, and the rotating direction of the outer roller 121 is not parallel to the rotating direction of the plurality of inner rollers 122. For example, the outer roller 121 is rotated in a longitudinal direction, and the inner roller 122 is rotated in a transversal direction. In FIG. 3, when the floor washing robot 1 moves forward, two rear outer rollers 121 rotate forward with respect to the machine body 11. All the inner rollers 122 in the two rear outer rollers 121 do not rotate with respect to two rear outer rollers 121. The front outer roller 121 does not rotate with respect to the machine body 11 and the inner roller 122 contacting the floor in the front outer roller 121 rotates forward with respect to the front outer roller 121. The other inner rollers 122 in the front outer roller 121 do not rotate with respect to the front outer roller 121.

In this embodiment, the outer roller 121 of each omnidirectional wheel 12 is a U-shaped fixed block 123, equiangularly and pivotally coupled to the lower circumferential surface 118 of the lower baseboard 115 of the machine body 11. Since there are three omnidirectional wheels 12, therefore the outer rollers 121 are pivotally coupled to the lower circumferential surface 118 of the lower baseboard 115 of the machine body 11 with an equal angle of 120° apart from each other.

In the figures, three washing discs 13 are also pivotally coupled to the lower baseboard 115 of machine body 11 with an equal angle of 120° apart from each other and rotated with respect to the machine body 11, and each washing disc 13 includes a plurality of brush structures 131 installed downward.

In this embodiment, the plurality of brush structures 131 of each washing disc 13 are arranged in a spiral form, and each washing disc 13 includes a gear 133, and the gear 133 of each washing disc 13 includes a hollow shaft 132.

In the figures, the power source 16 is installed to the upper baseboard 114 of the machine body 11 and connected to each omnidirectional wheel 12 and each washing disc 13 respectively. In this embodiment, the power source 16 includes three omnidirectional wheel motors 161 and a washing disc motor 162, and each omnidirectional wheel motor 161 is connected to each omnidirectional wheel 12, and the washing disc motor 162 is connected to each washing disc 13 through the gear 133 of each washing disc 13.

Figure 4:
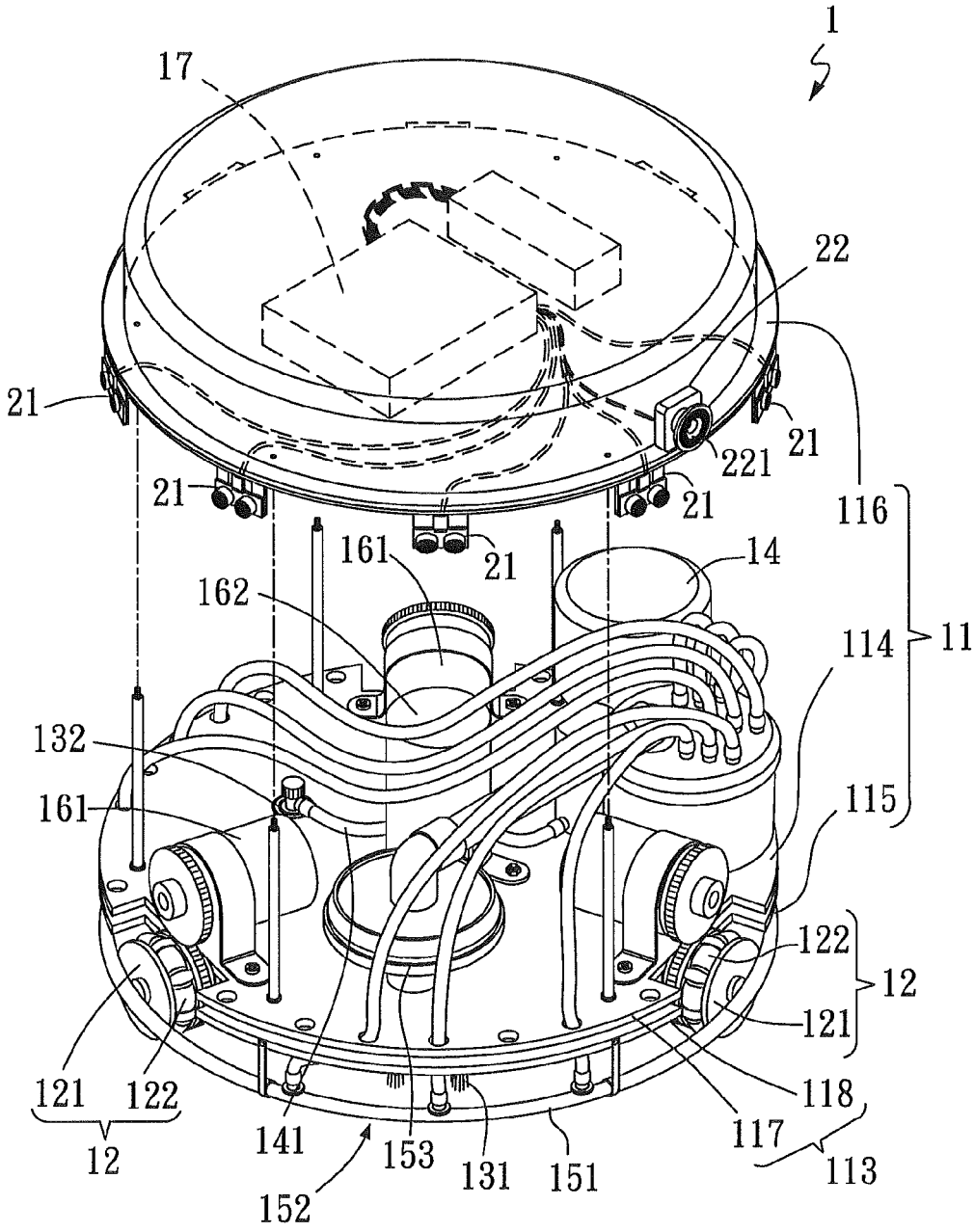
FIG. 4 another exploded view of a first preferred embodiment of the present invention.
Figure 5:
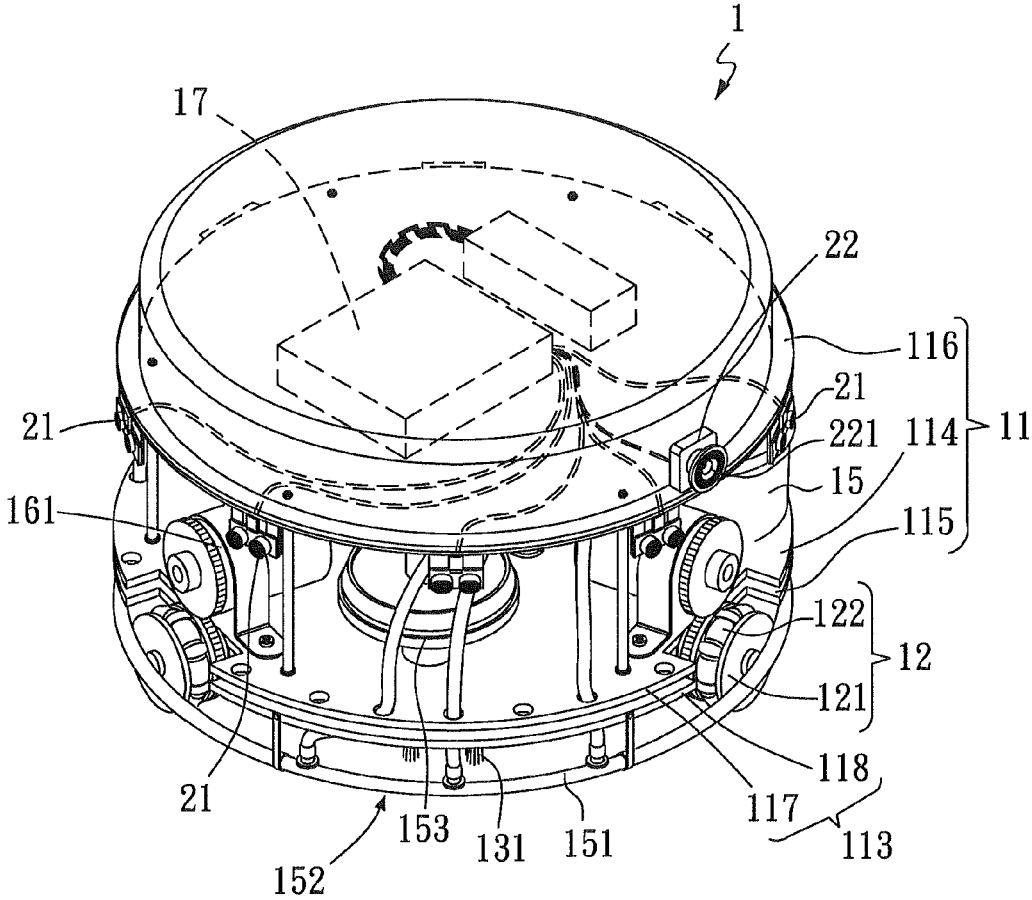
FIG. 5 is another perspective view of a first preferred embodiment of the present invention.
Figure 6:
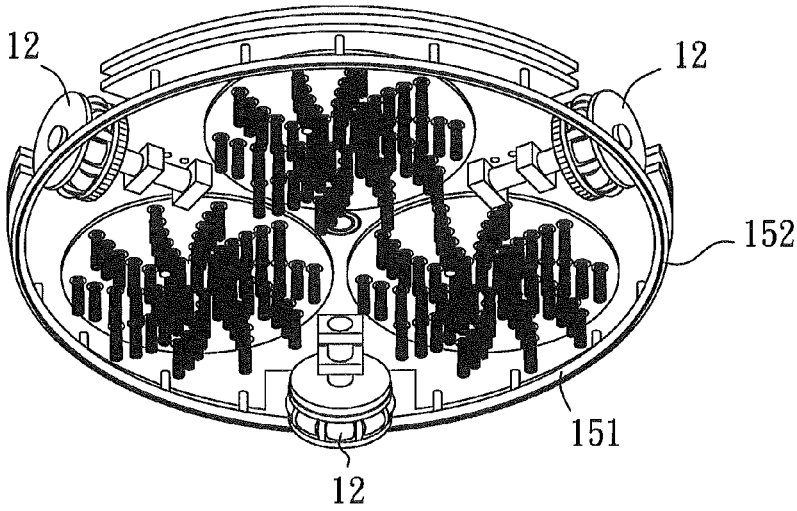
FIG. 6 is a perspective view from another viewing angle of a first preferred embodiment of the present invention.

Referring to FIGS. 4 to 6 respectively for another exploded view of the invention, another perspective view of the invention, and a perspective view of a first preferred embodiment viewing from another viewing angle, the whole structure of the floor washing robot 1 comprises a water spray device 14, a vacuum device 15 and a control unit 17. The machine body 11 includes a lid 116, an upper baseboard 114 and a lower baseboard 115 stacked sequentially with each other.

Referring to FIGS. 1, 4, 5 and 6, the water spray device 14 is installed to the upper baseboard 114 of the machine body 11 and includes three water spray pipelines 141 (only one spray pipeline 141 is shown due to the viewing angle of the figure), and each water spray pipeline 141 is extended to each washing disc 13 correspondingly. In this embodiment, each water spray pipeline 141 of the water spray device 14 is passed through the hollow shaft 132 of each washing disc 13 and extended to each washing disc 13.

Further, the vacuum device 15 is installed to the upper baseboard 114 of the machine body 11 and includes a vacuum pipeline 151, and the vacuum pipeline 151 has a slit 152 (as shown in FIG. 6).

Further, the control unit 17 is installed to the lid 116 of the machine body 11 and electrically coupled to the water spray device 14, the vacuum device 15 and the power source 16. In this embodiment, the control unit 17 is a control chip.

In a washing operation, the control unit 17 controls the power source 16 to drive each omnidirectional wheel 12 and each washing disc 13 to rotate with respect to the machine body 11, and also controls the water spray device 14 to spray water (including detergent) to each washing disc 13 through each water spray pipeline 141 for the washing job, while controlling the vacuum device 15 to vacuum dusts or wastewater through the slit 152 of the vacuum pipeline 151 during and after the washing operation.

The vacuum pipeline 151 is in a ring shape, and the slit 152 is disposed along the vacuum pipeline 151, and thus the slit 152 is also in a ring shape (360°). In the meantime, each omnidirectional wheel 12 is disposed inside the scope of the ring-shaped vacuum pipeline 151, such that the ring-shaped vacuum pipeline 151 vacuums the dusts or wastewater through the slit 152, and an omnidirectional (360°) vacuum of the dusts and wastewater can be achieved without having the problem of a dead corner or a hard-to-reach spot.

With the aforementioned angular design of the structure of the omnidirectional wheel 12, the floor washing robot 1 of the invention can clean a floor in a house freely without requiring the floor washing robot 1 to make turns at a certain spot on a particular path due to the limitation of the mechanical design. In other words, the floor washing robot 1 of the invention can move forward in any direction freely under the posture direction. With the washing disc 13 having the aforementioned angular design and the brush structures 131 arranged in a spiral form, the present invention can greatly increase the washing range and the washing area to enhance the cleaning effect.

This embodiment further uses a vacuum pump 153 for a vacuum by a negative pressure. However, the persons ordinarily skilled in the art can anticipate and use other methods for such vacuum purpose easily.

Referring to FIGS. 4 and 5 again, a plurality of obstacle sensors 21 can be installed equiangularly and respectively to the lid 116 of the machine body 11 and electrically coupled to the control unit 17 such as an infrared sensor or a supersonic sensor, so that when the floor washing robot 1 encounters an obstacle while it is moving forward, the floor washing robot 1 can detect the obstacle and change its traveling direction to avoid the obstacle.

The lid 116 of the machine body 11 further includes an auto-charging sensor 22 electrically coupled to the control unit 17, and the auto-charging sensor 22 includes a camera 221 (such as a charge-coupled device or complementary metal oxide semiconductor camera, CCD/CMOS camera) that uses an image capturing method for an automatic charging operation of the floor washing robot 1. In other words, the floor washing robot 1 can be charged automatically at an automatic charging station (not shown in the figure), and the automatic charging station designs certain special symbols (such as three color dots) for the camera 221 to capture an image for a matching and guide the floor washing robot 1 to the automatic charging station for a battery charge.

In addition, the structural design such as the way of installing the omnidirectional wheel 12 can lower the overall height of floor washing robot 1, so that the floor washing robot 1 can be applicable to a place under furniture with a smaller height such as a place under a sofa.

Figure 7:
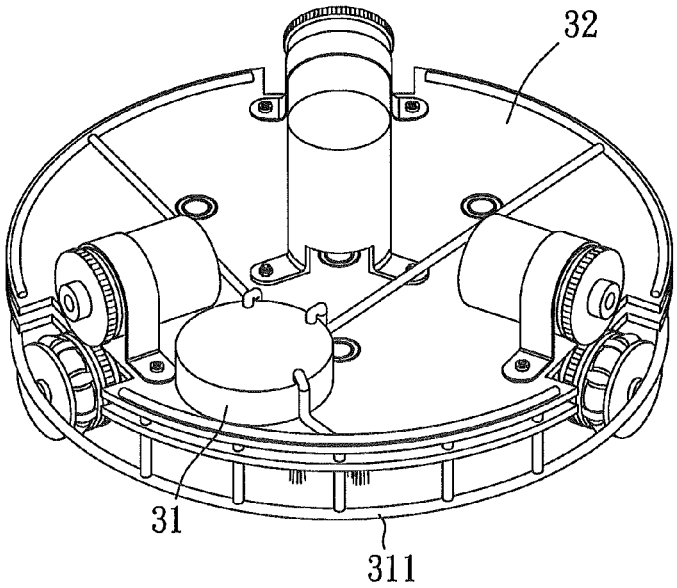
FIG. 7 is a perspective view of a second preferred embodiment of the present invention.

Referring to FIG. 7 for a perspective view of a second preferred embodiment of the present invention, the structure of this embodiment is substantially the same as the first preferred embodiment with an exception that the vacuum pipeline 311 of the vacuum device 31 of this embodiment can be installed flexibly during manufacture, depending on the limited space. For example, a section of the vacuum pipeline 311 as shown in FIG. 6 is attached flatly onto the upper baseboard 32 and the vacuum pump 153 of the first embodiment (as shown in FIG. 4) can be integrated directly into the vacuum device 31. Therefore, the design of this embodiment can avoid wasting any space by changing the installation layout, in addition to achieving the same effect of the first preferred embodiment.

In summation of the description above, the floor washing robot of the invention can effectively overcome the shortcomings of the prior art having a limitation on the angle of the moving posture of the floor washing robot and improve the cleaning effect. The invention complies with the requirements of patent application, and thus is duly filed for patent application.

While the invention has been described by means of specific embodiments, numerous modifications and variations could be made thereto by those skilled in the art without departing from the scope and spirit of the invention set forth in the claims.

What is claimed is:

1. A floor washing robot, comprising:

a machine body, having a circumferential surface;

at least three omnidirectional wheels, each having an outer roller and a plurality of inner rollers, and the outer roller being equiangularly and pivotally coupled to the circumferential surface of the machine body and rotated with respect to the machine body, and the plurality of inner rollers being pivotally coupled to the outer roller and rotated with respect to the outer roller;

at least one washing disc, pivotally coupled to the machine body and rotated with respect to the machine body, and the at least one washing disc having a plurality of brush structures installed downwardly;

a water spray device, installed to the machine body and including at least one water spray pipeline, and the at least one water spray pipeline being extended to the at least one washing disc;

a vacuum device, installed to the machine body and including at least one vacuum pipeline, and the vacuum pipeline having a slit, wherein the vacuum pipeline is a ring shape, and the slit is disposed along the vacuum pipeline, and wherein each omnidirectional wheel is disposed inside the scope of the vacuum pipeline;

a power source, installed to the machine body and coupled to each omnidirectional wheel and the at least one washing disc respectively; and a control unit, installed to the machine body and electrically and respectively coupled to the water spray device, the vacuum device and the power source.

2. The floor washing robot of claim 1, wherein the at least one washing disc includes a gear, and the power source is coupled to the at least one washing disc through the gear of the at least one washing disc.

3. The floor washing robot of claim 2, wherein the gear of the at least one washing disc includes a hollow shaft, and the at least one water spray pipeline of the water spray device is passed through the hollow shaft of the at least one washing disc and extended to the at least one washing disc.

4. The floor washing robot of claim 1, wherein the plurality of brush structures of the at least one washing disc are arranged in a spiral form.

5. The floor washing robot of claim 1, wherein the power source includes at least three omnidirectional wheel motors and a washing disc motor, and each omnidirectional wheel motor is coupled to each omnidirectional wheel respectively, and the washing disc motor is coupled to the at least one washing disc.

6. The floor washing robot of claim 1, wherein the control unit is a control chip.

7. The floor washing robot of claim 1, wherein the machine body includes a lid, an upper baseboard and a lower baseboard, and the lid, and the upper baseboard and the lower baseboard are stacked sequentially with each other, and the circumferential surface includes an upper circumferential surface and a lower circumferential surface, and the upper circumferential surface is disposed at the upper baseboard, and the lower circumferential surface is disposed at the lower baseboard.

8. The floor washing robot of claim 7, wherein the outer roller of each omnidirectional wheel is equiangularly and pivotally coupled to the lower circumferential surface of the lower baseboard of the machine body; the at least one washing disc is pivotally coupled to the lower baseboard of the machine body; the water spray device, the vacuum device and the power source are installed to the upper baseboard of the machine body; and the control unit is installed to the lid of the machine body.

9. The floor washing robot of claim 8, wherein each omni-directional wheel is pivotally coupled to the lower circumferential surface of the lower baseboard of the machine body through a U-shaped fixed block.

10. The floor washing robot of claim 7, further comprising a plurality of obstacle sensors equiangularly and respectively installed to the lid of the machine body and electrically coupled to the control unit.

11. The floor washing robot of claim 7, further comprising an auto-charging sensor installed to the lid of the machine body and electrically coupled to the control unit.

12. The floor washing robot of claim 11, wherein the auto-charging sensor further includes a camera.

* * * * *